United States Patent [19]

Isoe

[11] Patent Number: 5,006,393

[45] Date of Patent: Apr. 9, 1991

[54] MATERIAL AND METHOD FOR HEMMING A GARMENT

[75] Inventor: Mark R. Isoe, Northbrook, Ill.

[73] Assignee: QST Industries, Inc., Chicago, Ill.

[21] Appl. No.: 189,296

[22] Filed: May 2, 1988

[51] Int. Cl.[5] ..... B32B 3/02

[52] U.S. Cl. ..... 428/137; 428/192; 428/212; 428/352; 428/354; 428/355; 2/232; 2/269; 156/60

[58] Field of Search ..... 428/137, 192, 212, 352, 428/354, 355; 2/232, 269; 156/60

[56] References Cited

U.S. PATENT DOCUMENTS

| | | | |
|---|---|---|---|
| 3,166,765 | 1/1965 | Getchell | 2/269 |
| 3,168,749 | 2/1965 | Cala | 428/121 |
| 3,328,809 | 7/1967 | Payne et al. | 2/269 |
| 3,502,497 | 3/1970 | Crocker | 428/317.3 |
| 3,601,817 | 8/1971 | Abrams et al. | 2/269 |
| 3,766,566 | 10/1973 | Tadokoro | 2/232 |
| 4,007,835 | 2/1977 | Klothe | 428/200 |
| 4,273,827 | 6/1981 | Sweeney et al. | 428/307 |
| 4,320,634 | 3/1982 | Hashimoto et al. | 2/232 |
| 4,372,998 | 2/1983 | Shimada | 2/269 |
| 4,486,902 | 12/1984 | Sakai | 428/198 |
| 4,771,891 | 9/1988 | Sorensen et al. | 206/605 |

FOREIGN PATENT DOCUMENTS

| | | | |
|---|---|---|---|
| 2918410 | 11/1980 | Fed. Rep. of Germany | 2/269 |
| 0755267 | 8/1980 | U.S.S.R. | 2/269 |

*Primary Examiner*—Patrick Ryan

*Attorney, Agent, or Firm*—Eugene F. Friedman

[57] ABSTRACT

A material and method for hemming garments, especially trousers, by persons lacking satorial skills. On the material appears both a pressure-sensitive adhesive and a permanent fusible resin. Further, it has a row of slots cut into it. In use, the salesman or even the purchaser of a pair of trousers, for example, will mark the trouser leg and place the material on the inside of the leg, with the row of slots aligned with the marks. Folding the material upward until the slots sit along the line of the fold gives a trouser length as originally measured. The pressure-sensitive adhesive holds the material to the inside of the garment's cloth. The purchase of the garment may then try on the trousers again to see if, in fact, the hem falls at the exact correct location. If not, the pressure-sensitive adhesive allows the unfolding of the cuff and a further trial fold. When the garment's owner decides that the trial fold has the desired location, the application of heat to the garment at the hem will cause the fusible resin to melt, become enmeshed with the garment, and create a permanent fold. This technique eliminates the need to sew the hem.

54 Claims, 2 Drawing Sheets

MATERIAL AND METHOD FOR HEMMING A GARMENT

BACKGROUND

Typically, the purchaser of a pair of slacks has the choice between a finished cuff or an open bottom on the pant legs. The open leg has the advantage, of course, that, with proper tailoring, it will have a length precisely as desired by the purchaser.

However, the unfinished cuff on a pair of new trousers has serious disadvantages. They center primarily upon the necessity of a skilled tailor to provide the appropriate hem on the trouser legs. This procedure adds substantially to the cost of the slacks initially. Additionally, the purchaser must often wait several days to have the tailoring completed and will then face the necessity of returning to the store of purchase to retrieve his new pants.

Moreover, even after suffering through the requirements of having the trouser legs finished, the purchaser will often find that the tailoring has not proved correct. He will then have to repeat the procedure, wait additional time, and again return to the store to obtain his trousers.

As a result of the difficulty and expense involved in correctly finishing slacks with open legs, many purchasers simply opt for pants already having a finished bottom. That however, may entail wearing slacks not having exactly the correct length for the individual involved. In fact, a large proportion of the individuals should wear slacks having legs of different lengths due to their having unequal lengths in their lower appendages or simply having a posture which places one hip lower than the other. The purchase of refinished slacks precludes this adjustment and leaves the wearer having a pair of slacks without the most desired fit.

Various efforts in the past have attempted to improve the process for forming a hem on a garment. Oftentimes, this is involved utilizing a fabric having an embedded fusible substance often in the form of a thread, to obviate the need for sewing Such efforts appear in U.S. Pat. Nos. 3,168,749 to A. Cala, 3,766,566 to S. Tadokoro, 4,320,634 to K. Hashimoto et al., 4,372,998 to Y. Shimada, and 4,486,902 to K. Sakai.

W. M. Klothe's U.S. Pat. 4,007,835 shows a strip of a nonwoven fabric having a fusible resin on only one side. A row of perforations extends down the strip parallel to one side of it. The strip of material assists in providing folds along three selected lines in a material to which it attaches through its fusible resin. However, the patent contains no suggestion on how to use the material to achieve trial folds in garments' hems.

U.S. Pat. Nos. 3,936,944 to Z. P. Byne and 4,425,391 to B. J. Wilson both show a perforated, marked tape having a pressure-sensitive adhesive on one side. The adhesive permits the placement of the tape on cloth where the marking serves as guides for sewing. The perforations in the former patent allow the cutting of the widths and lengths of material needed for particular jobs. In the latter case, the perforations permit the separation of the tape into halves with separate markings for the locations of the buttons on one half and the button holes on the other. Clearly, this material finds no use in forming a permanent bond between two sections of a fabric.

Similarly, U.S. Pat. No. 3,853,595 shows a sewing tape with a pressure-sensitive adhesive. The adhesive possesses characteristics which preclude it from gumming a needle passing through it during the sewing of the fabric. The patent, however, shows no particular use for the sewing tape other than holding patterns to fabrics and the like. It certainly accomplishes no permanent bonding between component parts of a garment.

Accordingly, the search continues for fabrics finding use in the construction and altering of garments. This should have particular use in materials aiding in the hemming of garments.

SUMMARY

A desirable material may find use both to provide a temporary hem on a garment and, generally upon heating, a permanent bond along the temporary fold. This material has a composition of a web of fabric having adhered on at least a portion of one side a temporary adhesive. A substantially permanent adhesive also adheres to the web.

The temporary adhesive, usually a pressure-sensitive substance, allows the trial of a particular hemline to see if it provides the appropriate length. If not, the hem may be unfolded for a further try.

The permanent adhesive generally takes the form of a fusible resin. When a correct length has been selected, the application of heat, for example through an iron, makes the fold, and thus the hem, permanent.

The web of material may further include a series of openings passing through the material. The openings, or slots, lie in a row substantially parallel to one edge of the fabric. Aligning this row of slots with the usual tailoring marks on the fabric makes sure that the temporary and perhaps permanent fold will occur at the desired location since the line of slots offers substantially less resistance to the web's folding than the remainder of the fabric.

A particularly beneficial construction material includes a first web composed of a fabric and having an edge. A second web composed of a fusible resin adheres along and extends beyond at least a portion of the edge of the first web. This fusible resin, upon the folding of the fabric, makes direct contact with the two portions of the fabric folded upon each other. Heating the garment's fabric with the fusible between these two layers results in the fusible melting and permanently bonding the two layers to each other.

Alternately, a material for aiding the construction and alteration of clothing includes a web of fabric having an edge. A temporary adhesive then sits on one side of the web. A row of openings appears in the web along and substantially parallel to at least a portion of the web's edge. The row of openings facilitates the folding of a fabric to which it attaches along the predetermined line where the row itself sits. The temporary adhesive permits a trial fold of the garment with which it finds use. Once a proper fold has resulted, a permanent bond between the layers of the garment may be accomplished through the usual techniques of sewing and the like.

Making the first type of material mentioned above involves placing on at least a portion of one side of a web of fabric a temporary adhesive. A permanent adhesive is also adhered to the web. Again, the temporary substance may take the form of a pressure-sensitive adhesive while the latter finds general usefulness as a fusible resin.

Alternately, a useful material may result from adhering along and extending beyond the edge of a first web of fabric a second web composed of a fusible resin. The resin, extending off the edge of the web, may find use in adhering two layers of material of a garment together.

Lastly, a useful material results from first forming a row of openings lying substantially parallel to an edge in a web of fabric. A temporary adhesive affixes to at least one side of the web along the edge.

Forming a hem on a garment with one of these materials first involves affixing, with a temporary adhesive at a predetermined location on the interior surface of the of the garment's cloth, a web of fabric. A first portion of the garment's cloth is folded, with a portion of the web, along a predetermined line on the web. The first portion of the garment contacts another portion while the folded over portion of the web contacts the segment that did not fold over. Lastly, the two portions of the garment's cloth along with at least one of the portions of the additional web permanently attach to each other through the use of a permanent adhesive. This completes the formation of the garment's hem.

However, after temporarily attaching the various folded over portions to the main body of the materials, the wearer or sales person may discover that the hem fails to occur at the correct location. At this point, the folded over and temporarily attached portions are separated from each other. The web then separates from the garment's material. Repeating the process for attaching the web to the material, refolding, and temporarily attaching the various components permits the evaluation of the new location for the hem. When this proves acceptable, the permanent fusion may then take place to give the permanent hem.

DETAILED DESCRIPTION

Figure 1:
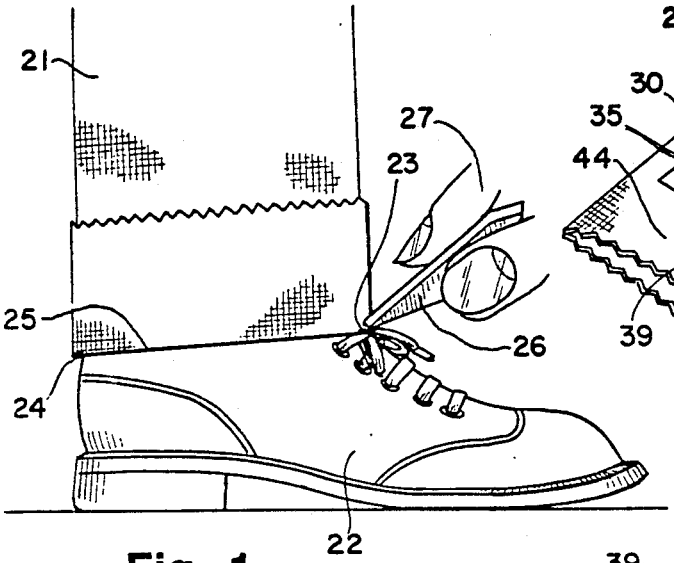
FIG. 1 shows the marking of the desired length as the first step in heming a trouser leg.

FIG. 1 shows a trouser leg 21 on a wearer 22 undergoing measurement by the placement of the marks 23 and 24 at the fold 25. As usual, the marks 23 and 24 emanate from the piece of wax 26 held by the individual 27.

Figure 2:
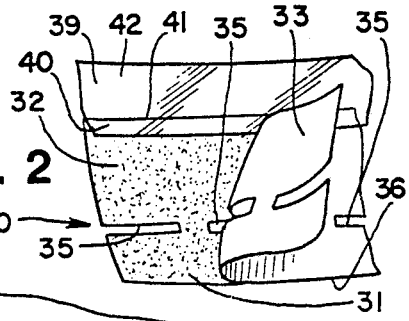
FIG. 2 shows the removal of a protective strip to uncover a temporary adhesive on a web that will permit the making of a permanent hem without sewing.

The construction aid material utilized to form the desired hem, or cuff, appears generally at 30 in FIG. 2. The construction material 30 first includes the woven or nonwoven fabric 31 on which sits the coating 32 of a temporary adhesive. The waxed paper 33 sits on top of and protects the pressure-sensitive adhesive 32. Removing it as shown in FIG. 2 makes the web of fabric 30 available for use as discussed below.

The web 30 also has the row of openings cut into it. The openings 35 form a row which lie substantially parallel to, inter alia, the bottom edge 36.

At the top of the material 30 sits the web, or sheet, of fusible resin 39. The lower portion 40 of the sheet 39 permanently attaches to the top 41 of the web 31. The remainder at the top 42 extends beyond the edge. Eventually, it will contact both sides of a folded over hem. Upon the application of heat, it will form a permanent bond with both portions of the garment's fabric to make permanent the folded hem.

Figure 3:
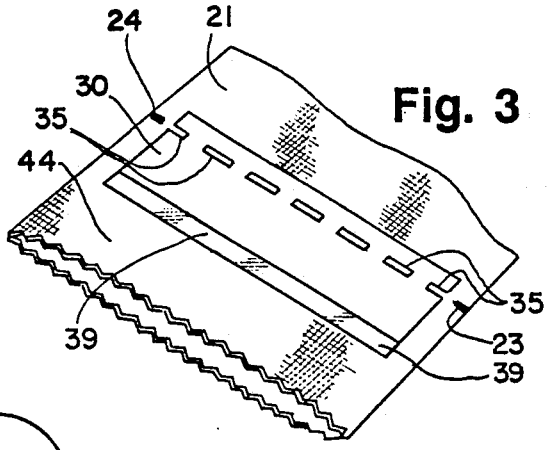
FIG. 3 shows the web of FIG. 2 attached to the garment of FIG. 1 turned inside-out with the temporary adhesive holding it in place.

After the marking of the desired location for the cuff bottom shown in FIG. 1, the construction of the permanent hem next involves turning the hem of the pant leg 21 inside out. This results in the marks 23 and 24 appearing on the outside of the leg as shown in FIG. 3.

With the protective layer 33 undergoes removal from the temporary adhesive 32 on the material 30. The operator then places the construction aid material 30, with the temporary, pressure-sensitive adhesive 32 facing downward, on the pant leg 21. He specifically aligns the openings 35 with the marks 23 and 24 as shown in FIG. 3. The pressure-sensitive adhesive, of course, will keep the construction material 30 in place on the cuff leg 21. If an excess of material remains at the bottom 44 of the pant leg 21, the operator may cut it off to provide for a more desirable feel to the bottom of the trouser.

At this point, the trousers are then turned back inside in. It has a temporary cuff formed by folding the pant leg and the construction material 30 along the row of openings 35. The slots 35, of course, facilitate the fold at the correct location since the material more readily bends along that line.

The construction material 30 ma include the temporary adhesive 32 on both sides. This would help keep the temporary cuff in position. However, in practice, this proves unnecessary; the temporary adhesive 32 on the bottom of the material 30 and the row of openings 35 serve to provide a temporary cuff with sufficient longevity to last until the cuff becomes permanent as discussed below.

Figure 4:
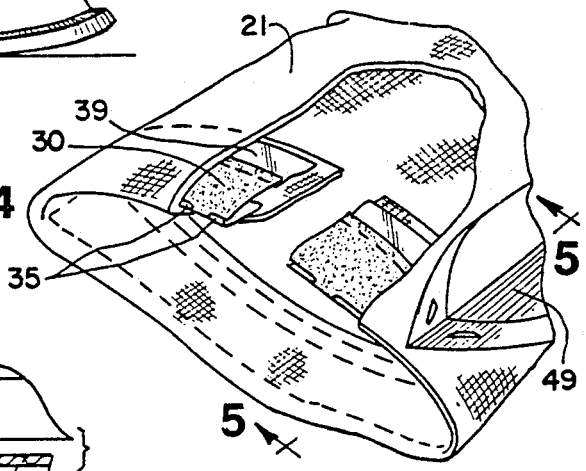
FIG. 4 shows the garment of FIGS. 1 to 3 with the construction material of FIGS. 2 and 3 folded over and becoming permanently bonded through the use of the heat of an iron.
Figure 5:
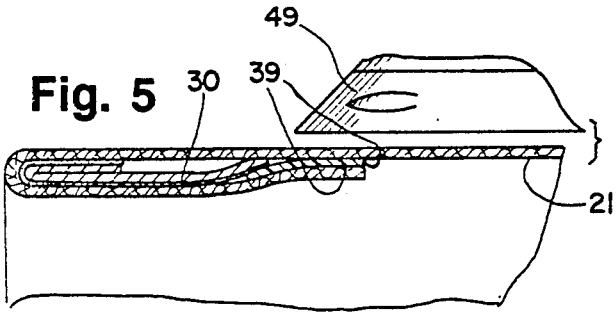
FIG. 5 gives a cross-sectional view along the line 5—5 of the hemmed trouser leg of FIG. 4.

After turning the garment inside in, the pant leg 21 with a temporary cuff will appear as shown in FIG. 4. At this point, the wearer may try the pants on to see that the cuff falls at the correct location. Should he not approve the cuff's location, the construction aid material 30 may be removed, the pants marked again for a new cuff. Repeating the process arrives again at the configuration shown in FIG. 4 but at a new location for the cuffs.

When the wearer indicates his satisfaction with the cuff's location, the temporary cuff may then become permanent. It simply requires the placing of heat, such as through the iron 49. This causes the fusible resin 39 to melt, make contact with the garment's fabric, cool, and provide a permanent bond and thus a permanent hem. The wearer thus has a permanent cuff on his trousers which required only minimal time and effort to produce.

Figure 6:
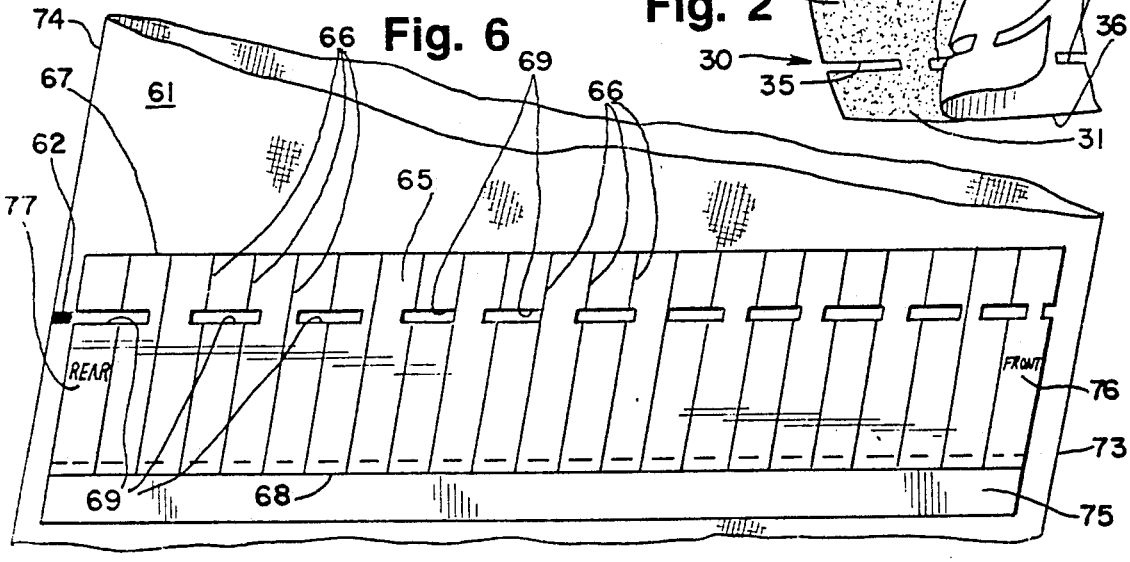
FIG. 6 shows a construction aid material having parallel lines to give to the hem a cant with a desired angle.

FIG. 6 shows another trouser 61 upon which, however, the wearer desires to have a canted cuff. In other words, he desires a cuff that makes a slight angle relative to the sides of the trousers 61.

Again, the mark 62 indicates the presumed desired location of the cuff. However, in the instance shown in FIG. 6, the wearer has indicated his desire for a canted cuff, that is, one that runs at an angle relative to the front and rear creases in the trouser leg. To accomplish this, the construction aid material 65 includes the lines 66 that form nonperpendicular angles with the top 67 and the bottom 68 of the material 65. Furthermore, the row of openings 69 fall on a line that runs parallel to the top 67 and bottom 68. Thus, the printed lines 66 make nonperpendicular angles with the row of openings 69.

In operation, the wearer, the salesperson, or some other operator will place the material 65 on the fabric 61 with the printed lines 65 running parallel to the front crease 73 and the rear crease 74 of the trouser leg 61. This will result in the row of openings 69 making nonperpendicular angles with the creases 73 and 74. The remainder of the operation proceeds as above with the material shown in FIGS. 1 through 5. Again, a temporary adhesive on the back of the material 65 allows for a trial cuff. Upon achieving the correct location, heating fusible resin 75 makes the cuff permanent. The material 65 may also include the printed reminders of "front" 76 and "rear" 77 to make sure that the cant runs in the correct direction.

Figure 7:
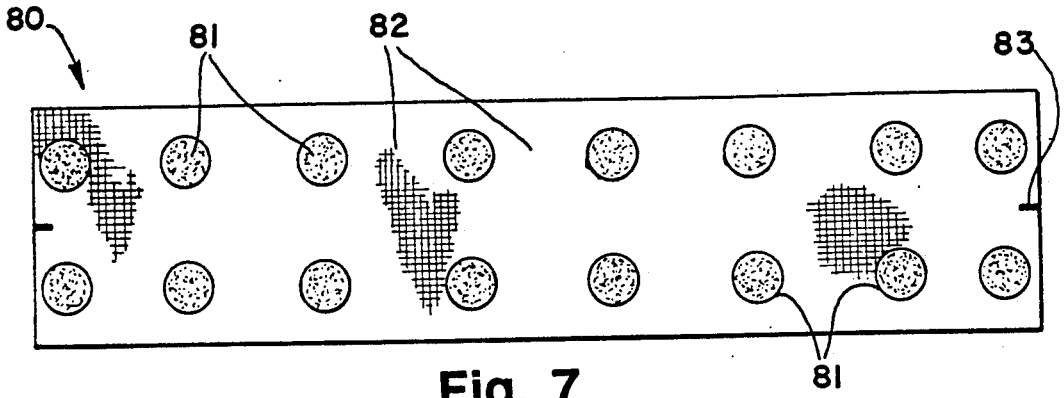
FIG. 7 shows a construction aid material having patches of a temporary adhesive and a coating of a permanent adhesive.

FIGS. 7 to 10 show other types of construction aid material that may well also find use in constructing hems or cuffs on garments. Thus FIG. 7 shows a construction aid material generally at 80 having the patches of temporary adhesive 81 which generally takes the form of a pressure-sensitive adhesive. The remainder of the construction material 80 includes the permanent adhesive 82 which covers the areas not displaying the pressure-sensitive adhesive 87. The permanent adhesive 82, as seen in FIG. 7, covers a greater portion of the area of the construction aid material 80 than does the temporary pressure-sensitive adhesive 81.

The marks 82 and 83 may serve to help generally locate the construction aid material 80 on the inside of the garment undergoing hemming or cuffing. However, without a row of openings, the fold should proceed carefully to make sure that it occurs at the right location. However, if it does not do so, the temporary nature of the pressure-sensitive adhesive permits the refolding and a further attempt at correctly locating the hem or cuff.

Figure 8:
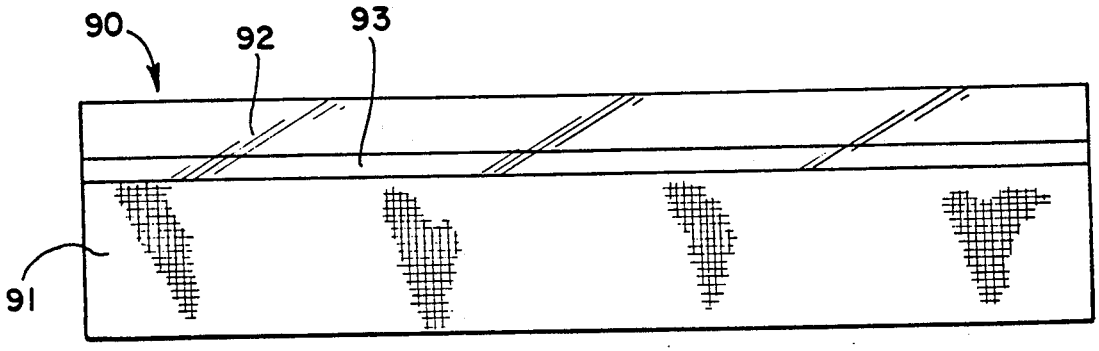
FIG. 8 depicts a construction aid material having a sheet of fusible resin attached to and extending beyond the edge of a web of fabric.

The construction aid material 90 in FIG. 8 includes the web of fabric 91 and a fusible resin 92 which attaches to the top 93 of the web 91. As seen in FIG. 8, the sheet of fusible resin 92 extends well beyond the web's top 93. This permits, as seen in FIGS. 1 through 6, the resin 92 to melt under the application of heat to adhere portions of the garment to each other.

Figure 9:
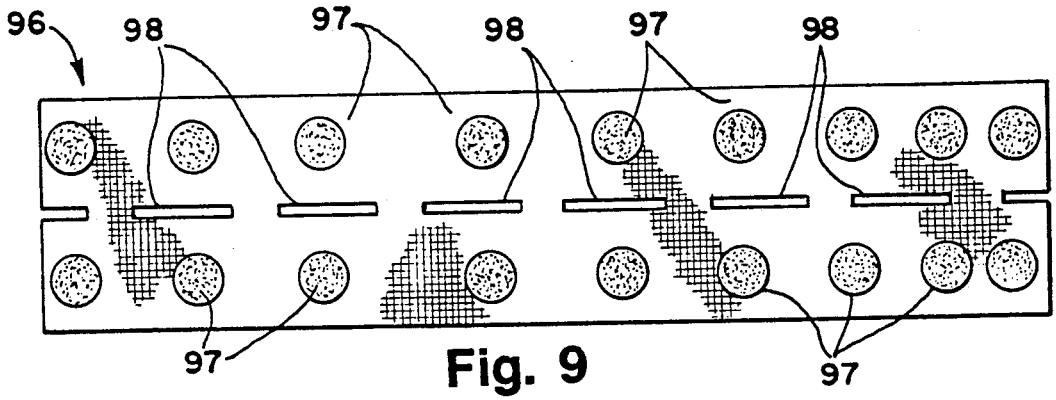
FIG. 9 gives a construction aid material having a row of openings and patches of a temporary adhesive.

A further construction aid material appear generally at 96 in FIG. 9. That material includes the patches of temporary, or pressure-sensitive adhesive 97 as well as the row of openings 98. The temporary adhesive patches 97 permit the placement of the material 96 on the fabric of the garment. The openings 98 permit the folding of that garment at a predetermined location To make the fold permanent would require some other type of afixation such as sewing.

Figure 10:
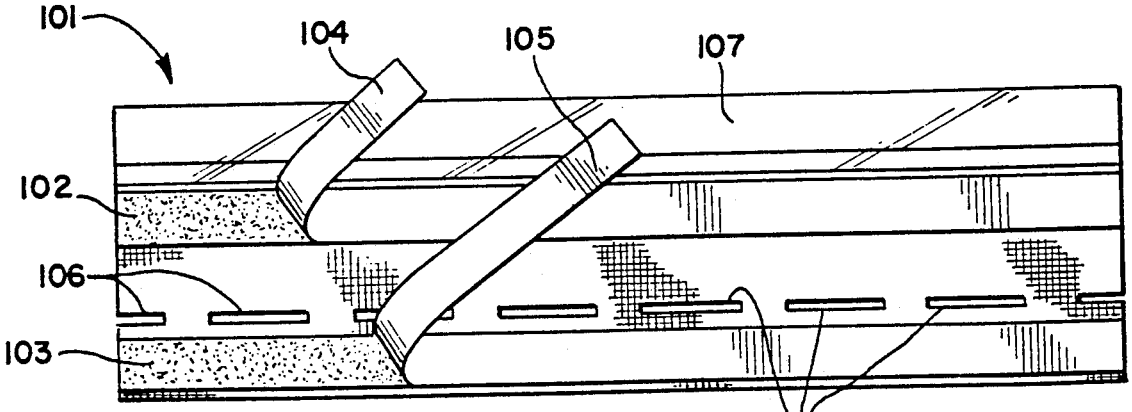
FIG. 10 portrays a construction aid material having strips of temporary adhesive with protecting covers partially removed, a row of openings, and a web of clear plastic resin attached to and extending beyond the edge of the material.

Lastly, FIG. 10 shows the construction aid material generally at 101 having the two strips 102 and 103 of pressure-sensitive adhesive running along its length. The cover papers 104 and 105 protect the pressure-sensitive adhesive until the need arises to place the material 101 on a garment. They may have different coloring to facilitate their use. Removing them, as has begun in FIG. 10, exposes the strips of adhesive 102 and 103 for use.

Otherwise, the construction aid material 101 has the same features as the material indicated at 30 in FIGS. 1 to 6. Thus, it includes the row of openings 106 and the sheet of fusible resin 107 at its top. These features operate in the same fashion as do their counterparts in the earlier figures.

Accordingly, what is claimed is:

1. A material for aiding the construction and alteration of clothing comprising a web of fabric having (1) adhered on at least a portion of one side thereof and exposed to contact a temporary adhesive and (2) adhered to said one side of said web and exposed to contact a substantially permanent adhesive.

2. The material of claim 1 wherein said temporary adhesive is a pressure-sensitive adhesive.

3. The material of claim 2 wherein said permanent adhesive is a fusible resin.

4. The material of claim 3 wherein said web has an edge and wherein a row of openings is formed in said web and lies substantially parallel to a portion of said edge.

5. The material of claim 4 including a plurality of lines drawn on said material substantially parallel to each other and making a nonzero angle relative to said row of openings.

6. The material of claim 4 wherein said one side of said web includes both said fusible resin and said pressure-sensitive adhesive and said fusible resin and said pressure-sensitive adhesive each cover less than the entire surface of said one side with each appearing on at least a portion of said surface of said one side.

7. The material of claim 6 wherein said fusible resin covers a greater portion of the area of said one side than said pressure-sensitive adhesive.

8. The material of claim 6 wherein said web is a first web, said fusible resin constitutes a second web, a first portion of said second web is attached to said one side of at least a portion of said first web, and a second portion of said second web extends beyond the outer limit of said first web.

9. The material of claim 4 wherein said fabric is nonwoven.

10. The material of claim 4 wherein said fabric is woven.

11. A material for aiding the construction and alteration of clothing comprising (1) a first web composed of a fabric and having an edge and (2) a second web composed of a fusible resin adhered along and extending beyond at least a portion of said edge of said first web.

12. The material of claim 11 wherein said web has an edge and wherein a row of openings is formed in said web and lies substantially parallel to a portion of said edge.

13. The material of claim 12 wherein said fabric is nonwoven.

14. The material of claim 12 wherein said fabric is woven.

15. The material of claim 12 further including a plurality of lines drawn on said material substantially parallel to each other and making a nonzero angle relative to said row of openings.

16. The material of claim 12 further including a temporary adhesive adhered to said web.

17. The material of claim 16 wherein said temporary adhesive is a pressure-sensitive adhesive and wherein at least one side of said web includes both said fusible resin and said pressure-sensitive adhesive and said fusible resin and said pressure-sensitive adhesive each cover less than the entire surface of said one side with each appearing on at least a portion of said surface of said one side.

18. The material of claim 17 wherein said fusible resin covers a greater portion of the area of said one side than said pressure-sensitive adhesive.

19. A material for aiding the construction and alteration of clothing comprising a web of fabric having an edge, a temporary adhesive placed on one side of said web, a row of openings in said web along and substantially parallel to at least a portion of said edge, and a plurality of lines drawn on said material substantially parallel to each other and making a nonzero angle relative to said row of openings.

20. The material of claim 19 wherein said temporary adhesive is a pressure-sensitive adhesive.

21. The material of claim 20 wherein said temporary adhesive is affixed to one side of said web and covers less than the entire area of said one side.

22. The material of claim 21 further including a permanent adhesive adhered to said one side of said web.

23. The material of claim 19 wherein said fabric is nonwoven.

24. The material of claim 19 wherein said fabric is woven.

25. A method of making a material useful in the construction and alteration of clothing comprising:

(A) placing on at least a portion of one side of a web of fabric a temporary adhesive;

(B) adhering to said web of a permanent adhesive;

(C) placing a plurality of openings through said material, said openings forming a row substantially parallel to at least a portion of an edge of said fabric; and (D) drawing a plurality of substantially parallel lines on said web wherein said lines make a nonzero angle relative to said row of openings.

26. The method of claim 25 wherein said temporary adhesive is a pressure-sensitive adhesive.

27. The method of claim 27 wherein said permanent adhesive is a fusible resin.

28. The method of claim 29 wherein said pressure-sensitive adhesive is placed on one side of said fabric on less than all of the area of said one side; said fusible resin is placed on said one side of said fabric on less than the area of said one side; and the area occupied by said pressure-sensitive adhesive on said one side is less than the area occupied by said fusible resin on said one side.

29. The method of claim 28 wherein said web is a first web, said fusible resin constitutes a second web, and said fusible resin is adhered to said web by attaching a first portion of said second web to said one side of said first web with a second portion of said second web extending beyond a section of the edge of said first web.

30. The method of claim 29 wherein said fabric is nonwoven.

31. The method of claim 27 wherein said fabric is woven.

32. A method of making a material useful in aiding the construction and alteration of clothing comprising adhering along and extending beyond the edge of a first web composed of a fabric of a second web composed of a fusible resin.

33. The method of claim 32 further including placing a plurality of openings through said material, said openings forming a row substantially parallel to an edge of said fabric.

34. The method of claim 33 wherein said fabric is nonwoven.

35. The method of claim 33 wherein said fabric is woven.

36. The method of claim 33 further including the steps of drawing a plurality of substantially parallel lines on said fabric wherein said lines make a nonzero angle relative to said row of openings.

37. The method of claim 33 further including placing a temporary adhesive on said fabric.

38. The method of claim 37 wherein said temporary adhesive is a pressure-sensitive adhesive, said temporary adhesive is placed on said one side of said web, and the area occupied by said temporary adhesive on said one side is less than the area occupied by said fusible resin on said one side.

39. A method of making a material useful in aiding the construction and alteration of clothing comprising (A) forming a row of openings in a web of fabric having an edge, said row being substantially parallel to said edge, and (B) affixing a temporary adhesive to one side of said web at least along said edge, and drawing a plurality of substantially parallel lines on said fabric wherein said lines make a nonzero angle relative relative to said row of openings.

40. The method of claim 39 wherein said temporary adhesive is a pressure-sensitive adhesive.

41. The method of claim 40 further including the step of placing a permanent adhesive on said fabric.

42. The method of claim 39 wherein said fabric is nonwoven.

43. The method of claim 39 wherein said fabric is

44. A method of forming a hem on a garment formed from a material with an adhesive web, said method comprising:

(A) affixing with a temporary adhesive attached to a web of fabric at a predetermined location on the surface of the material of said garment, said web of fabric;

(B) folding a first portion of said material and a second portion of said web along a predetermined line line on said web against a third portion of said material and a fourth portion of said web; and (C) permanently attaching with a permanent adhesive attached to said web said third portion and one of said second and fourth portions to said first portion.

45. The method of claim 44 wherein said temporary adhesive is a pressure-sensitive adhesive.

46. The method of claim 45 wherein said permanent adhesive is a fusible resin.

47. The method of claim 46 wherein said pressure-sensitive adhesive is on at least one of said second and forth portions of said web and, when said web is folded along said predetermined line, makes contact with the other of said second and fourth portions of said web.

48. The method of claim 46 wherein said predetermined location is a first predetermined location and further including, prior to folding said first portion of said material and said second portion of said web along said predetermined line on said web, performing the following steps:

(A) folding a fifth portion of said material and a sixth portion of a web of fabric along a predetermined line on said web against a seventh portion of said material and an eighth portion of said web; unfolding said fifth portion of said material and said sixth portion of said web from against said seventh portion of said material and said eighth portion of said web;

(C) removing said web from said material;

(D) affixing with a temporary adhesive at a second different predetermined location on the interior surface of the material of said garment, a web of fabric.

49. The method of claim 48 wherein said first and second webs of fabric are different.

50. The method of claim 46 wherein said fabric includes a plurality of openings through said fabric, said openings forming a row substantially parallel to an edge of said fabric, and said predetermined line is located along said row of openings.

51. The method of claim 50 wherein said web of fabric includes a plurality of lines drawn on said fabric substantially parallel to each other and making a nonzero angle relative to said row of openings, and said predetermined line on said web is said row of openings.

52. The method of claim 51 wherein the permanent attachment of said third and fourth portions to said first and second portions is accomplished by applying heat to said fusible resin.

53. The material of claim 1 wherein said permanent adhesive covers a greater portion of the area of said one side than said temporary adhesive.

54. A material for aiding the construction and alteration of clothing comprising a web of fabric having (1) adhered on at least a portion of one side thereof a temporary adhesive, (2) adhered to said web a substantially permanent adhesive, (3) an edge, (4) a row of openings formed in said web and lying substantially parallel to a portion of said edge, and (5) a plurality of lines drawn on said material substantially parallel to each other and making a nonzero angle relative to said row row of openings.

* * * * *